US005106655A

United States Patent [19]

Boissevain et al.

[11] Patent Number: 5,106,655

[45] Date of Patent: Apr. 21, 1992

[54] CROSS-DIRECTIONAL SMOOTHNESS CONTROLLER AND METHOD OF USING THE SAME

[75] Inventors: Mathew G. Boissevain, Los Altos; Bruce S. Taylor; Robert L. Beaman, both of San Jose, all of Calif.; Laslo Dudas, Quebec, Canada

[73] Assignee: Measurex Corporation, Cupertino, Calif.

[21] Appl. No.: 303,713

[22] Filed: Jan. 27, 1989

[51] Int. Cl.[5] ..... B05D 3/12

[52] U.S. Cl. ..... 427/296; 427/361; 118/117; 162/137; 162/206

[58] Field of Search ..... 427/296, 361; 118/68, 118/101, 117; 162/137, 206

[56] References Cited

U.S. PATENT DOCUMENTS

| | | | |
|---|---|---|---|
| 2,369,450 | 2/1945 | Fisher et al. | 162/136 X |
| 3,024,129 | 3/1962 | Brundige | 162/206 X |
| 3,362,869 | 1/1968 | Welsh | 162/136 X |
| 3,853,604 | 12/1974 | Fleissner | 117/119.8 |
| 4,543,737 | 10/1985 | Boissevain | 34/92 |
| 4,573,402 | 3/1986 | Sharma | 100/38 |
| 4,580,355 | 4/1986 | Boissevain | 34/54 |
| 4,685,389 | 8/1987 | Boissevain | 100/93 RP |
| 4,738,196 | 4/1988 | Boissevain | 100/93 RP |
| 4,765,067 | 8/1988 | Taylor | 34/23 |
| 4,786,529 | 11/1988 | Boissevain | 427/296 |

OTHER PUBLICATIONS

Tappi Journal, Feb. 1988, "Process Control and Automation of Supercalenders", by Hannu Malkia.

Commonly assigned U.S. patent application Ser. No. 07/303,405 to Boissevain.

*Primary Examiner*—Shrive Beck

*Assistant Examiner*—Alain Bashore

*Attorney, Agent, or Firm*—Spensley Horn Jubas & Lubitz

[57] ABSTRACT

An apparatus for controlling the cross-directional smoothness profile of the surface of a calenderable material substantially independently of the materials's caliper profile. A plurality of adjustable nozzles selectively direct jets of steam of selected velocities against sections of the material across the material's width and in counterflow to its movement, immediately before the material enters the last nip of a calender stack. Built-in steam control valves are provided to control the amount of steam applied to each section. Suction means may also be provided upstream of the nozzles, with reference to the movement of the calenderable material, to remove excess steam and thus prevent undesirable condensation on adjacent structures. The smoothness profile may be monitored and compared to a desired smoothness profile and the valves and nozzles may be adjusted accordingly.

24 Claims, 4 Drawing Sheets

CROSS-DIRECTIONAL SMOOTHNESS CONTROLLER AND METHOD OF USING THE SAME

BACKGROUND OF THE INVENTION

1. Field of the Invention

The present invention relates to the field of creating smooth surfaces on sheet materials, and more particularly to an apparatus for controlling the cross-directional smoothness profile of a paper sheet.

2. Related Art.

One of the parameters used in grading sheet materials is the smoothness of the material's surface. In the paper production process, various grades of paper having different surface smoothness are produced to suit various applications. Generally, smooth surfaces enhance the printability of the paper. Bulk paper is typically produced in a continuous sheet and wound in rolls having dimensions 12–36 feet in the cross-direction (i.e., across the width of the sheet) and uniform smoothness on the paper surface is generally desirable. For example, in the situation where the roll of paper is cut into page-size sheets, the consistency of the smoothness of the individual pages is dependent upon the uniformity of the smoothness of the original bulk paper roll.

Paper production typically involves a calendering process which includes pressing paper material between two or more calender rolls arranged in a stack, to obtain desired physical characteristics. Calendering paper can change its density, thickness (caliper), and surface characteristics, including smoothness. In conjunction with calendering, steam is frequently applied to paper before it is calendered so as to moisten and heat the paper and thereby affect certain of its characteristics. For example, both the caliper of the paper and the smoothness of its surface may be impacted by applying steam to the paper surface, followed by pressing the paper between a series of calender rolls. The paper absorbs the steam and the paper fibers are softened by the heat and moisture thereby increasing the pliability and compressibility of the paper. As the steam-treated paper comes into contact with the calender rolls, it is then compressed and its surface is smoothed by the "ironing" (i.e., pressing and rubbing) actions of the rolls. The caliper and smoothness profiles created are dependent on the amount of moisture and heat penetrating the paper. Typically, to achieve the desired smoothness of the paper surface, only the surface fibers of the paper need to be wetted and heated. To substantially affect the caliper profile of the paper, on the other hand, the steam must be allowed to penetrate deeper into the paper.

A common problem encountered in using a steam treatment prior to calendering paper to affect the smoothness of the calendered material, is the concurrent effect on the caliper of the material. "Coupled" to the increase in the smoothness of the paper is a decrease in its caliper. More predictable caliper and smoothness profiles of paper could be achieved if the two characteristics could be "decoupled" (i.e., controlled independently) by applying steam so as to heat and wet the surface fibers only after the desired caliper profile has been created.

Another common problem encountered in affecting the smoothness of the calendered material using a steam treatment is the non-uniformity of the smoothness achieved in the cross-direction. Localized variations in the amount of steam applied to the surface of the bulk paper may affect the smoothness uniformity. Also, there are other variables in the calendering process such as temperature and calender roll pressure which may affect the amount of steam required for a particular degree of smoothness. A more uniform smoothness profile can be obtained if the amount of steam directed at different sections of the paper surface can be controlled.

A further problem associated with the application of steam in calendering is that excess steam that has not been absorbed by the paper condenses on cool surfaces of the adjacent structure of the calender system. For example, the steam may condense on the calender roll, which will wet the paper as the roll contacts the paper. The extra moisture of the calender roll in addition to the moisture applied directly to the sheet from the steam supply will affect the moisture distribution and hence the smoothness and other physical properties of the paper. For example, when droplets of water contact the sheet and the sheet is subsequently calendered, the opacity of the sheet will be permanently affected in the wetted area, thereby leaving a visible mark on the sheet. In addition, excess steam may condense on a cool portion of the paper surface at a location where steam treatment is not intended, thereby affecting the smoothness profile.

SUMMARY OF THE INVENTION

The present invention is directed towards an apparatus for distributing variable amounts of steam against the surface of a calenderable sheet material, such a paper, to effect a desired smoothness profile of the material while minimizing the effect on its caliper profile. The invention substantially "decouples" smoothness control from caliper control by providing an apparatus which directs variable amounts of steam against sections of the surface of the sheet material being calendered after the material's desired caliper profile has been achieved. The invention provides simple, efficient and precise cross-directional control over the amounts of steam directed against the various sections of the calenderable material by means of built-in flow control valves spaced in the cross-direction of the material. The invention additionally provides a simple means for removing excess steam from the steam treatment area to prevent undesirable condensation on adjacent surfaces.

In the illustrated embodiment, the smoothness controller of the present invention comprises a single elongated steam plenum having a curved face. The curved face of the steam plenum is positioned alongside the sheet of material being calendered, at a location immediately before the sheet enters the last "nip" (i.e. the space between two adjacent calender rolls) of the calender stack. The time allowed for steam penetration before the sheet is pressed between the rolls is thus very limited and only the surface fibers of the sheet are heated and moistened.

Pressurized steam is delivered to the steam plenum by a main steam supply manifold. A plurality of removable nozzles, disposed along the length of the steam plenum, discharge jets of steam against sections of the surface of the sheet being calendered. The steam is preferably discharged in a direction opposite to the direction of travel of the sheet. The steam is discharged in the opposite direction of sheet travel to increase the relative steam-to-sheet velocity and thereby promote heat transfer efficiency by breaking up the boundary layer of air which is dragged along by the surface of the moving sheet and which would otherwise serve to insulate the sheet from the steam jets. Furthermore, the steam is discharged at an acute angle to the tangent of the calender roll around which the paper travels, so that the steam directly impinges the sheet.

The amount of steam discharged through each nozzle is controlled by a corresponding one of a plurality of flow control valves disposed inside the steam plenum, spaced along its length. Each valve includes a valve pipe which links the valve with a corresponding nozzle. Upon activation, each valve discharges a variable amount of steam from the steam plenum into its corresponding nozzle. By controlling the volume of steam discharged through each valve, the steam distribution on the surface of the calenderable material may be controlled to adjust its smoothness profile. Additionally, the velocity and volume of steam discharged through the nozzle exit slot may be increased or decreased by adjusting the nozzle exit slot size, thereby providing further control over the amount of steam being absorbed by the sheet.

To prevent condensation of excess steam on surfaces adjacent the steam treatment zone, a vacuum chamber is provided inside or adjacent to the steam plenum. Excess steam enters the vacuum chamber through a plurality of steam scavenger ducts located upstream (relative to the direction of movement of the sheet) from the nozzle.

A uniform smoothness profile of the surface of the calendered sheet material may be maintained by monitoring the smoothness profile using a smoothness sensor and adjusting the steam distribution accordingly. A smoothness sensor can monitor the smoothness profile on the sheet surface in the cross-direction of the sheet and generate a signal corresponding to the measured smoothness. The signal from this sensor is fed to a valve control device which adjusts the steam valves in the smoothness controller to thereby control the amount of steam applied to each section of the surface of the sheet material in the cross-direction.

BRIEF DESCRIPTION OF THE DRAWINGS

Like reference characters in the various drawings refer to like elements.

DETAILED DESCRIPTION OF THE INVENTION

The following description is of the best presently contemplated mode of carrying out the invention. This description is made for the purpose of illustrating the general principles of the invention and should not be taken in a limiting sense. The scope of the invention is best determined by reference to the appended claims.

Figure 1:
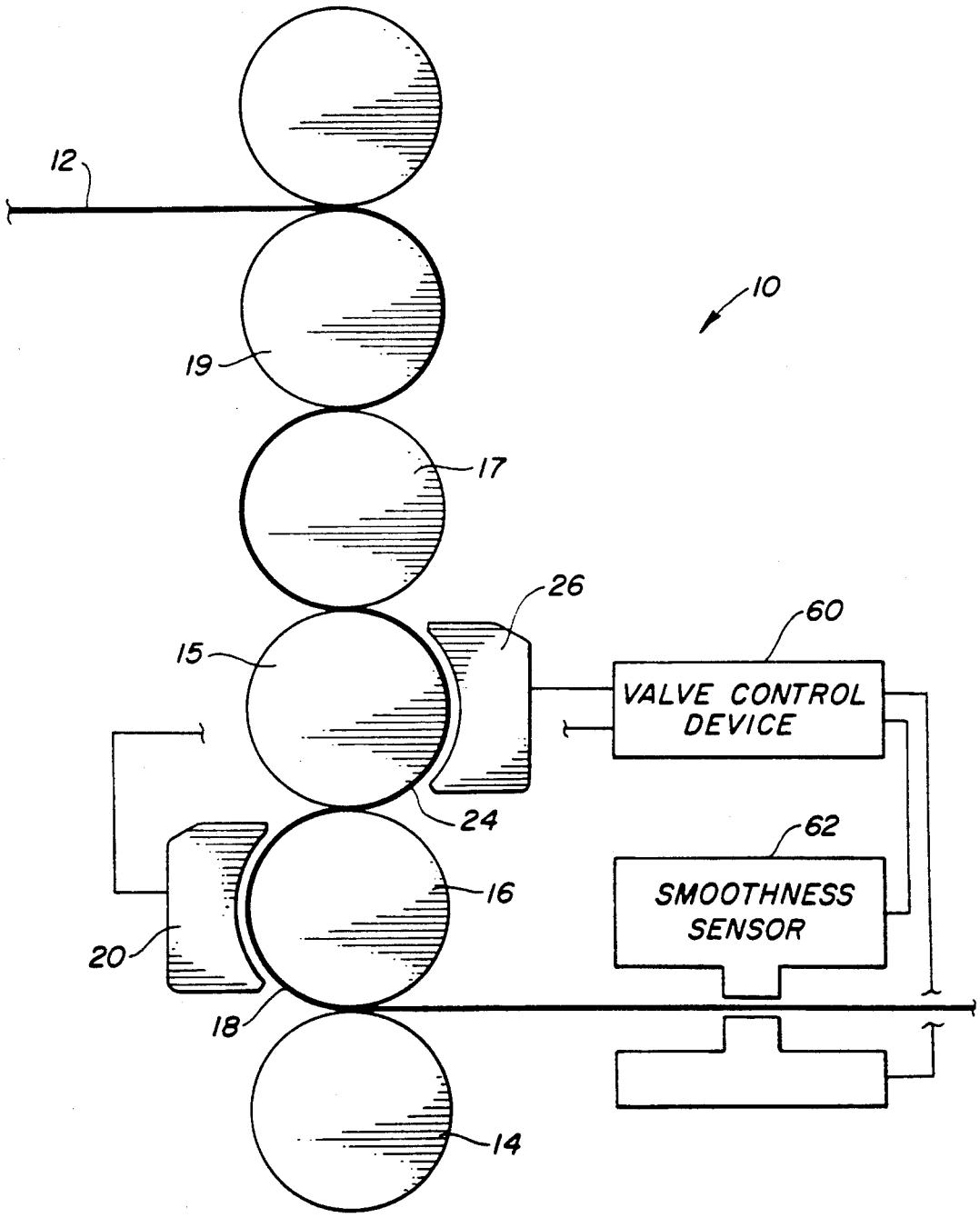
FIG. 1 is a side plan view illustrating a system of calender rolls for production of sheet material in which the invention may be utilized to steam treat the surface of the material to effect a certain smoothness profile.

FIG. 1 shows an example of a process with which the present invention may be used. FIG. 1 illustrates a system of calender rolls 10 suitable for pressing a sheet of calenderable material, such as paper 12, to obtain desired physical characteristics of the calenderable material. For convenience, the invention will be described hereafter with reference to paper as the calenderable material, however, the scope of the invention includes materials other than paper.

The system of calender rolls 10 includes a king roll 14 (the lowermost roll of the stack), a queen roll 16 (the roll immediately above the king roll 14), and a series of "intermediate" rolls 15, 17 and 19. Paper passes between the rolls of the calender stack in a path of a general "S" configuration and typically exits the calender stack after rounding the queen roll 16.

The paper may be smoothed by applying steam to the surfaces of the paper before the paper passes between certain rolls of the stack. Only the surface to which steam is applied is smoothed as it is pressed and rubbed by the calender rolls. When moisture and heat penetrate the sheet, its pliability and compressibility increases. The subsequent ironing action of the calender rolls upon the paper then compresses the sheet fibers and thereby causes increased smoothness and decreased caliper. This "coupled" effect on the caliper and smoothness profiles by exposure to steam and calendering, increases the difficulty of achieving the desired profiles of these two characteristics. To increase the smoothness of the surface 18 of the paper 12 with a minimal effect on the caliper of the paper (i.e., to decouple the two profiles), a smoothness controller 20 of the present invention is positioned adjacent the sheet surface 18 at a location immediately before the paper enters the nip 22 of the queen roll 16 and the king roll 14 at the location where the sheet is rounding the queen roll 16. The smoothness controller is positioned at this location to minimize the time between the exposure of the surface 18 to steam and the action upon it by the rolls. Preferably the sheet enters the last nip 22 of the calender stack approximately 1/40 of a second after passing the steam application zone 23. The heat and moisture penetration time is thus reduced, allowing only the surface fibers of the paper to become pliable and compressible while the core (i.e., the portion between the two sheet surfaces) of the paper retains its resilience to compression. Subsequent ironing by the calender rolls will thus have minimal effect on the caliper of the paper while having the desired smoothing effect on its surface. Moreover, by directing the jets of steam against the sheet while the sheet is in contact with the roll 16, the penetration of steam into the sheet is further minimized because steam cannot escape from the roll side of the sheet. The pressure gradient thus created across the thickness dimension of the sheet retards steam penetration into the sheet and thereby further decouples the caliper and smoothness parameters.

To smooth the other surface 24 of the paper 12, another smoothness controller 26 may be positioned adjacent the first intermediate roll 15 (the roll immediately above the queen roll 16). However, a slight coupled effect may be produced when the smoothness controller is positioned at this location since the heat and moisture penetration time available before the surface receives a final pressing in the last nip is extended.

Figure 2:
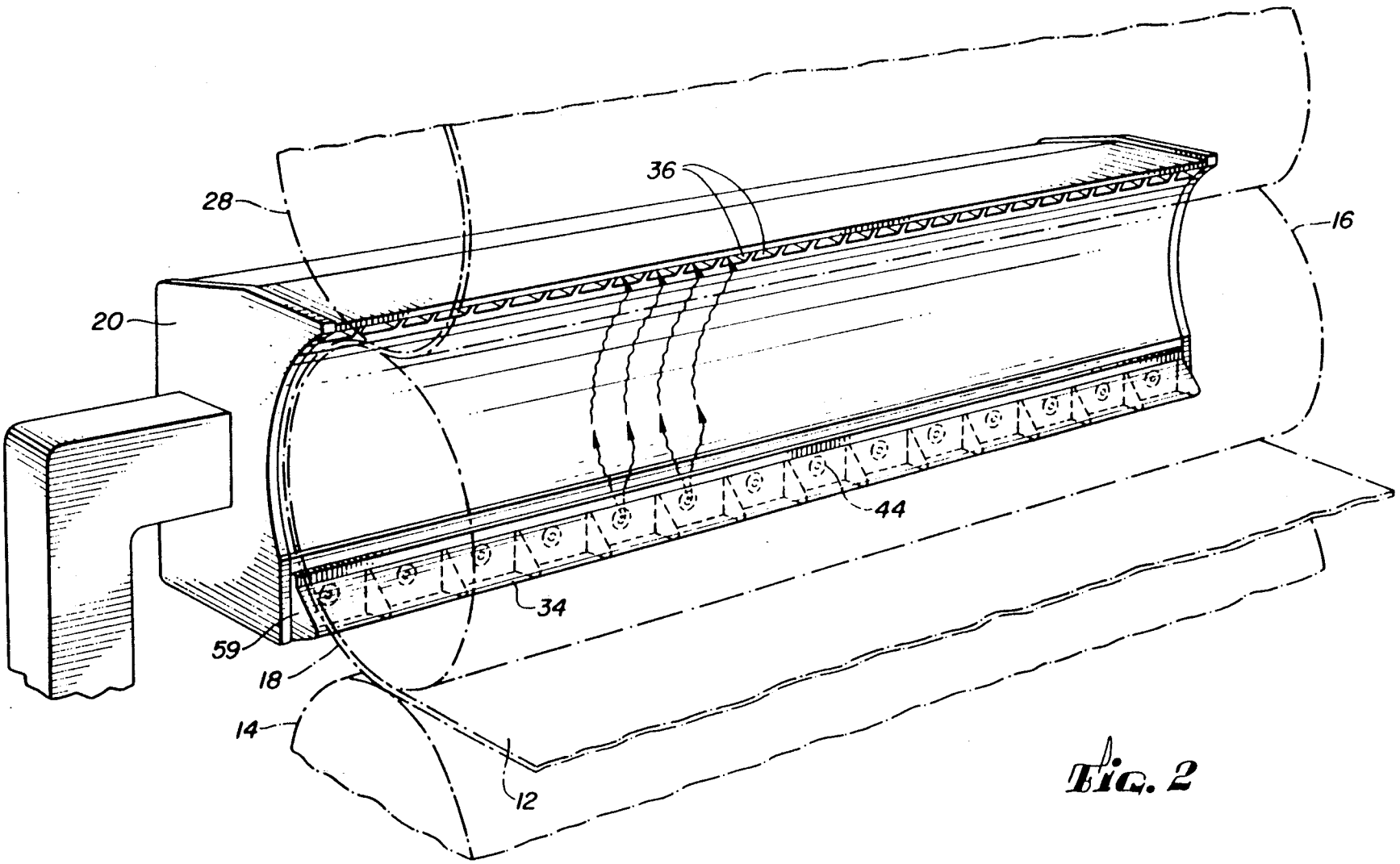
FIG. 2 is a perspective view of an embodiment of the present invention showing a plurality of nozzles and scavenger ducts disposed along the length of the steam plenum.

The structure of one embodiment of the smoothness controller of the present invention is described with reference to FIGS. 2 through 5. As illustrated in FIG. 2, the smoothness controller 20 extends alongside the queen roll 16 of the calender stack. The smoothness controller 20 is preferably positioned leaving an approximately ¼ to ½ inch gap 29 between it and the surface 18 of the paper 12 which travels between the queen roll 16 and the smoothness controller 20. In the illustrated embodiment, the smoothness controller 20 comprises means for containing steam adjacent the sheet of paper, such as, for example, a steam plenum 30 spanning the width of the sheet of paper (i.e., in the cross-direction). The face 32 of the steam plenum 30 is curved to substantially correspond to the curve of the queen roll 16. Different paper manufacturers utilize calender stacks having rolls of varying diameters, the degree of curvature of the face 32 of the steam plenum 30 will therefore vary.

Spaced along the downstream edge of the curved face 32 of the steam plenum 30 (with reference to the direction of travel of the paper) are a plurality of nozzles 34. Each nozzle 34 corresponds to one section or "slice" of the paper 12 in the cross-direction. Spaced along the upstream edge of the curved face 32 of the steam plenum 30 (with reference to the direction of travel of the paper), are a plurality of scavenger duct orifices 36 corresponding to the plurality of nozzles 34. In the embodiment shown in FIGS. 2 and 3, steam, which is preferably in a saturated state at 5 to 15 psig pressure, is delivered to the steam plenum 30 by a steam supply manifold 38. Variable amounts of steam are discharged from the steam plenum 30 through the nozzles 34. The amount of steam discharged through each nozzle 34 is individually controlled by a corresponding valve 40. Each valve 40 includes a valve opening 42 in flow communication with the steam plenum 30. Each valve 40 further includes a valve pipe 44. The valve pipe 44 traverses the width of the steam plenum 30 and connects to the nozzle 34. Each valve 40 also includes an actuator 46 to effect opening and closing of the valve. In the preferred embodiment, the valve actuators 46 are covered by a housing 48 mounted to the steam plenum 30.

Many types of well-known steam valves may be suitable to control the amount of steam discharged into each nozzle. For example, 16-position digital valves as disclosed in commonly assigned U.S. patent application Ser. No. 07/303,450 of Mathew G. Boissevain, entitled Digitally Incremented Linear Actuator and filed concurrently herewith, may be utilized. This patent application is incorporated herein by reference.

Upon actuation of the valve, a desired amount of steam from the steam plenum 30 is discharged into the nozzle 34. The steam is injected into the gap 29 between the paper surface 18 and the curved face 32 of the steam plenum 30 through the nozzle's exit slot 48. The steam is injected in counterflow to the roll rotation and at an acute angle (of, for example, 25 degrees) to the roll tangent. The counterflow arrangement improves the heat transfer efficiency of the steam by maximizing the steam-to-sheet relative velocity and disrupting the flow of "boundary layer" air which is entrained by the moving sheet and dragged into the gap 29. Injecting the steam at an acute angle to the roll tangent further improves the heat transfer efficiency of the steam since the steam directly impinges the paper.

Thus a large percentage of the steam discharged through the exit slot 48 condenses on the paper surface 18. As illustrated by the arrows in FIG. 3, the portion of the steam which does not condense on the paper surface 18, is deflected back and forth between the paper surface 18 and the face 32 of the steam plenum 30 as the steam moves upstream, against the paper movement. Each time the steam hits surface 18, some steam condenses on the paper surface. Hence, the steam discharged through the nozzle exit slot 48 treats a small area of the paper surface and pretreats a larger upstream surface area. As the uncondensed steam travels up the gap 29, its velocity decreases due to the opposing velocity of the boundary layer of air which flows into the gap 29 with the flow of paper and drags against the sheet surface.

Figure 3:
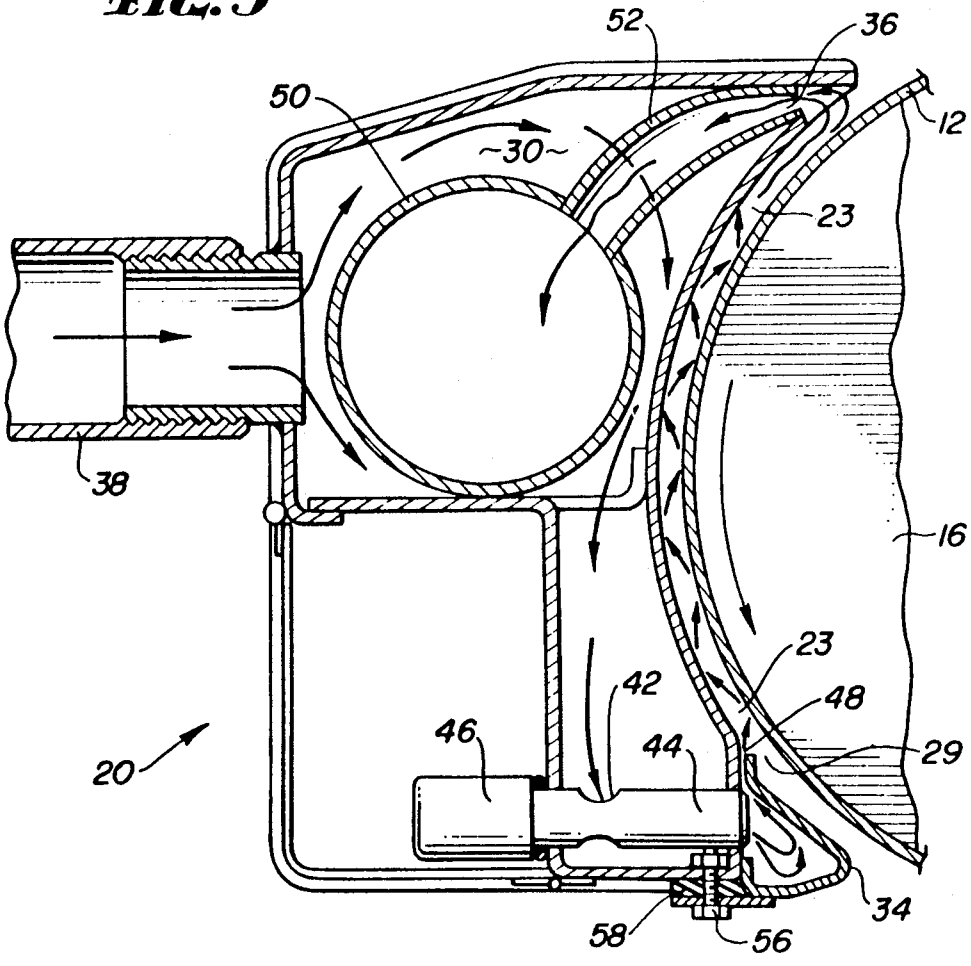
FIG. 3 is a cross-sectional view of an embodiment of the present invention illustrating a preferred internal structure of the steam plenum, the valve, and the nozzle.
Figure 5:
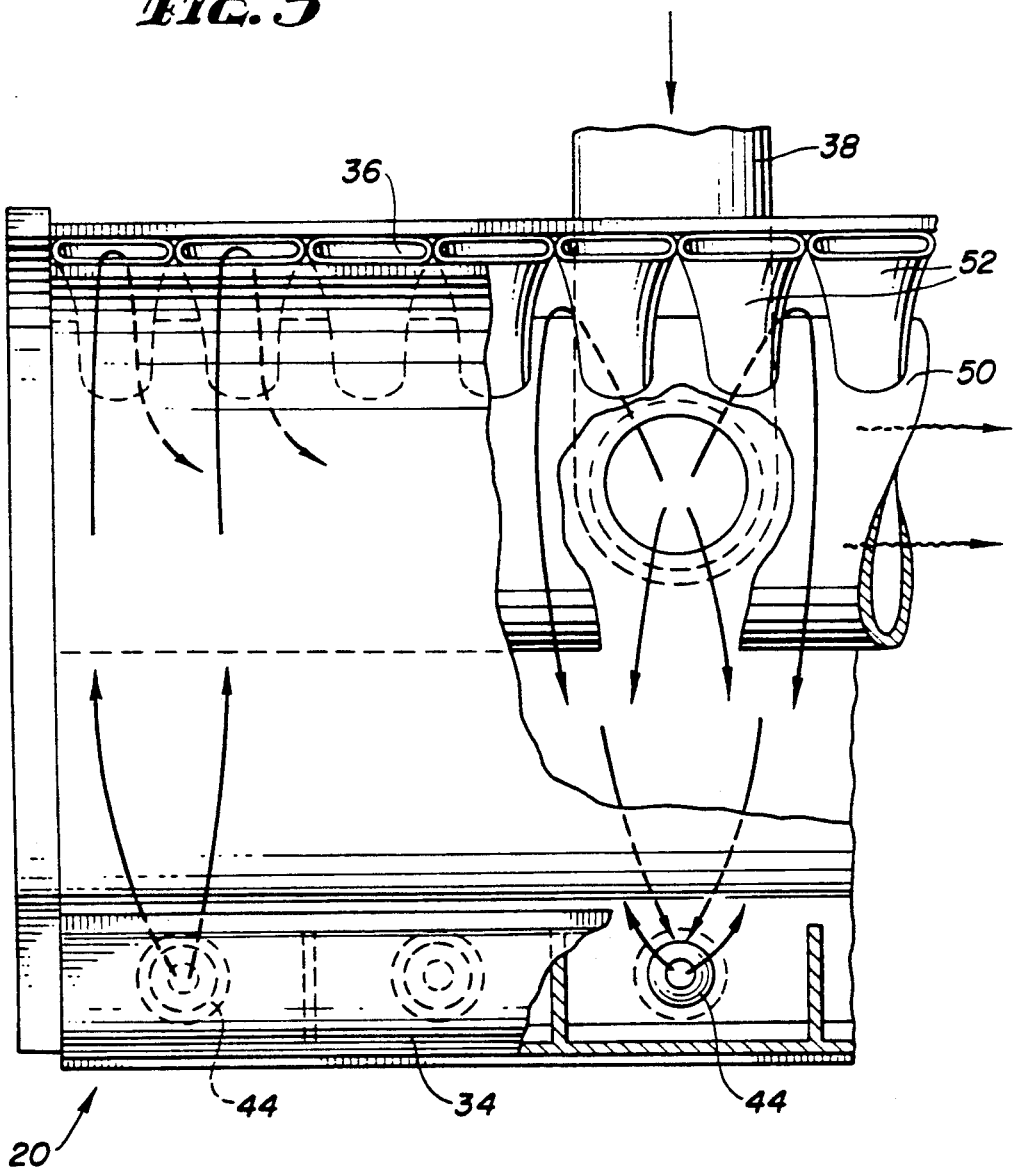
FIG. 5 is a partial front perspective view illustrating the movement of working fluid (e.g. steam) through an embodiment of the smoothness controller of the present invention.

To prevent condensation of steam on structures adjacent to the steam treatment zone 23 defined by the curved face 32 of the steam plenum 30 and the paper surface 18, a suction device is provided in the illustrated embodiment of the smoothness controller 20 to remove the steam which would otherwise escape from the steam treatment zone 23. As shown in FIGS. 3 and 5, a vacuum plenum 50 is provided within the steam plenum 30, spanning its length. A plurality of scavenger ducts 52 connect the vacuum plenum 50 to the plurality of scavenger duct orifices 36 spaced along the upstream edge of the curved face 32 of the steam plenum 30. The steam which has traveled upstream against the flow of boundary layer air has a relatively low velocity by the time it reaches the scavenger duct orifices 36 and therefore is easily sucked into the vacuum plenum 50 through the scavenger duct orifices 36. Because the velocity of the steam is greatly reduced by the time it reaches the scavenger duct orifices 36, only a relatively low powered vacuum motor is required to effectively suck the steam from the steam treatment zone 23 into the scavenger duct orifices 36. The steam suction confines the steam within the steam treatment zone 23 to prevent undesirable condensation of excess steam on adjacent surfaces other than the paper surface 18 facing the smoothness controller 20. Steam inside the steam plenum 30 maintains the temperature of the plenum face 32 above 190° F., thereby preventing condensation of steam on the face 32. To minimize the time necessary to heat up the face 32 on start-up of the smoothness controller 20, the face 32 is preferably made from a material having high thermal conductivity such as, for example, anodized aluminum.

Since the scavenger ducts 52, as well as the vacuum plenum 50, are encased within the steam plenum 30, their temperatures also remain above 190° F. Steam traveling through the steam scavenger ducts to the vacuum plenum 50 is therefore maintained in a gaseous state and droplet formation in the area of the scavenger duct orifices 36 may be avoided. The steam may then be easily removed from the vacuum plenum through an evacuation duct (not shown).

The arrangement of the plurality of valves 40 at intervals through the span of the smoothness controller 20 permits the amount of steam applied to the surface 18 to be variably controlled in the cross-direction. A desired steam distribution profile in the cross-direction may be controlled by selectively controlling each valve 40 associated with each nozzle 34. Consequently, since the smoothness achieved at each section is dependent on the amount of steam applied to the surface, uniform smoothness may be achieved by supplying the appropriate amount of steam at each section through the respective nozzle 34. Note, however, that it does not necessarily follow that, when different amounts of steam are supplied to the different nozzles and hence to different sections of the paper surface, the smoothness profile in the cross-direction will not be uniform. In the situation where a uniform smoothness profile in the cross-direction is desired, it may be necessary to discharge different amounts of steam through each nozzle in order to compensate for other variables in the paper making system which may affect the reaction of the paper surface to steam treatment.

By increasing the number of valves and associated nozzles, that is, increasing the number of corresponding sections of the paper surface in the cross-direction by decreasing the size of each nozzle, the degree of control over the smoothness profile may be increased. Typically, a maximum steam flow of approximately 30 Lbs/Hr/Ft of material width will be required. Thus, when the sheet surface is divided into six inch sections in the cross-direction, for example, a maximum flow rate of approximately 15 Lbs/Hr per valve would be achieved. The steam's temperature may preferably be controlled so that when it emerges from the valve pipe 44 it is slightly above that of saturated steam. In this way, a slight heat loss to the nozzle 34 will not result in condensation within the nozzle. Alternatively, a small drain hole (not shown) may be provided at the bottom of each nozzle 34.

Further control over the heat transfer from the steam to the sheet may be achieved with adjustments of the velocity at which the steam is discharged from the nozzles 34. The features of each nozzle 34 may more easily be understood with reference to FIGS. 4 and 5. In the embodiment illustrated in FIG. 4, the nozzle 34 is removably mounted to the lower side of the steam plenum 30 to form the lower edge of the smoothness controller 20. The nozzle 34 is preferably mounted with an adjustable bolt 56. A seal 58 made of a compressible material such as, for example, silicon rubber, may be placed between the nozzle 34 and the steam plenum 30 at the mounting site. With this arrangement, the velocity at which the steam is injected into the gap between the paper surface 18 and the curved face 32 of the steam plenum 30 may be adjusted. For example, when the bolt is tightened, the seal compresses and the nozzle tilts inward. The width of the exit slot 48 is thereby slightly decreased, increasing the velocity with which the steam is discharged. Conversely, when the bolt is loosened, the seal expands and the nozzle tilts outward. The width of the exit slot 48 is thereby slightly increased, decreasing the velocity with which the steam is discharged. It has been determined that for most applications an adequate velocity of the steam may be achieved when the width of the exit slot 48 measures 3/100-5/100 of an inch. It is important to precisely control the velocity of the steam. In addition to the effect of steam velocity on heat transfer to the sheet, if the steam velocity is too low upon exiting the nozzle 34, the steam may leak out of the bottom of the steam treatment zone 23 (i.e. downstream of the nozzle 34 with reference to the movement of the sheet), and may possibly condense on adjacent surfaces. On the other hand, if steam velocity at exit slot 48 is too great, the steam may overshoot scavenger duct orifices 36 and may again possibly condense on adjacent structures. The desired steam velocity at the exit slot 48 depends on the speed of the sheet, its surface smoothness, sheet temperature and possibly other factors.

Figure 4:
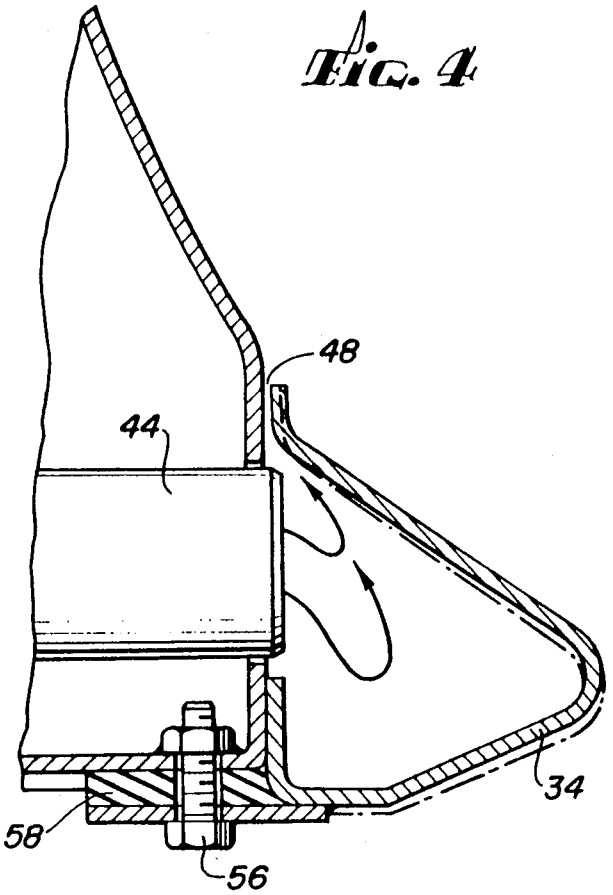
FIG. 4 is an enlarged illustration of the nozzle depicted in FIG. 3, illustrating two of the possible positions of the nozzle.

The nozzle mounting arrangement as depicted in FIG. 4, additionally allows complete removal of the nozzle to simplify, for example, cleaning thereof. The ability to clean the nozzle is particularly desirable when the smoothness controller is used to apply steam to paper in a paper mill since paper fibers, liberated during the operation of the calender, may become lodged in the nozzles. Mineral deposits (scale) from the steam supply system may also accumulate in the nozzles.

In the illustrated embodiment of the invention the nozzles 34 are formed from a single, sectionalized member 59. Thus all of the nozzles may be mounted, removed and/or adjusted by a single bolt; or alternatively, by two bolts, one disposed at each end of the plenum 20. In an alternate embodiment, each nozzle is a separate member and is independently mounted and, therefore, independently adjustable.

As is shown in FIG. 1, a computerized valve control device 60 may be employed to maintain a predetermined smoothness profile on the paper surface. A smoothness sensor 62 may be provided at a location downstream of the smoothness controller 20 to monitor the smoothness of the paper surface 18. The smoothness sensor 62 scans the sheet in the crossdirection and provides a signal corresponding to the degree of smoothness of the surface of each cross directional section or slice to the control device 60. Depending on the deviation in the measured smoothness of the paper surface from the desired smoothness profile, the valve control device 60 selectively transmits control signals to the actuators 46 of the valves 40 so that the valves 40 discharge the appropriate amount of steam through the nozzles 34 to achieve desired smoothness at each slice.

In summary, the present invention provides an apparatus for controlling the smoothness profile of a surface of a calenderable material substantially independently of its caliper profile, by selectively directing variable amounts of steam against sections of the surface in the cross-direction immediately before the material enters the last nip of the calender stack and preferably, but not necessarily, as the material travels around the queen roll of a calender stack. Built-in valves control the steam distribution in the cross-direction. The invention also provides a simple means for removing unused steam from the steam treatment area to prevent undesirable condensation on adjacent surfaces. Smoothness sensors may be used to detect the degree of smoothness of the surface and a valve control device may be used to activate the valves in accordance with the detected smoothness.

One preferred embodiment of the present invention has been described. Nevertheless, it will be understood that various modifications may be made without departing from the spirit and scope of the invention. For example, adjustable nozzles of different sizes and shapes may be provided and the number of scavenger ducts and corresponding orifices may be varied. Additionally, the shape of the steam plenum may be altered. Furthermore, although the present invention is described with reference to the smoothness of paper, the invention includes controlling, by steam treatment, physical characteristics other than smoothness on different types of materials. Also, a working fluid other than steam may be employed without departing from the principles of the present invention. Accordingly, it is to be understood that the invention is not to be limited by the specific illustrated embodiments, but only by the scope of the appended claims.

We claim:

1. An apparatus for discharging a controlled amount of steam against a sheet surface during calendering, comprising:

a substantially impermeable calender roll;

discharge means for discharging steam against a location of the sheet surface where the opposing sheet surface is backed by the calender roll; and a containing means, including a surface which substantially corresponds to the curvature of the calender roll, disposed in close proximity to the calender roll for substantially containing the discharged steam between the containing means and the sheet surface.

2. The apparatus of claim 1, wherein the discharge means includes a steam plenum and a plurality of nozzles and associated independently controllable valves disposed at intervals along the steam plenum, such that the discharge means is operable to discharge controllable amounts of steam against select cross directional sections of the sheet.

3. The apparatus of claim 2, wherein each nozzle is removably mounted to the containing means by a bolt, and wherein the velocity of the discharged steam may be increased by turning the bolt in a first direction and decreased by turning the bolt in a second direction.

4. An apparatus for discharging a controlled amount of steam against a sheet surface during calendering, comprising:

a calender roll; and discharge means for discharging steam against a location of the sheet surface where the opposing sheet surface is backed by the calender, wherein the discharge means is disposed so that the discharged steam impinges on the sheet surface substantially counter to the direction of rotation of the calender roll.

5. The apparatus of claim 4, further comprising suction means disposed upstream of the discharge means, with respect to the direction of travel of the sheet, for removing excess steam discharged by the discharge means and not condensed on the sheet surface.

6. The apparatus of claim 5, wherein the suction means includes a vacuum plenum disposed alongside the steam plenum, and a plurality of orifices disposed at intervals along the length of the vacuum plenum, the orifices being in flow communication with the vacuum plenum.

7. The apparatus of claim 1, further comprising:

a physical characteristic sensor disposed adjacent the sheet, wherein the sensor is operable to generate signals indicative of the physical characteristic of the sheet; and a valve control device, operatively coupled to the sensor and the discharge means, to receive the signals from the sensor and to control the discharge means based upon the signals and predetermined physical characteristic values.

8. The apparatus of claim 1, wherein the sheet is paper.

9. A system for controlling a physical characteristic of a sheet being calendered, comprising:

a calender stack including a plurality of calender rolls, wherein the calender stack has an upstream end and a downstream end and a plurality of nips formed between adjacent rolls of the calender stack; and a physical characteristic controller disposed to discharge fluid against the sheet immediately before the sheet is pressed at one nip of the calender stack, the one nip being located downstream from the nips affecting the desired caliper of the sheet, such that a physical characteristic of the sheet may be changed without affecting the desired caliper of the sheet.

10. The system of claim 9, wherein the one nip pressing the sheet is the last furthest downstream nip of the calender stack.

11. The system of claim 9, wherein the one nip pressing the sheet is the next to the last furthest downstream nip of the calender stack.

12. The system of claim 9, wherein the physical characteristic controller is disposed so that the fluid is discharged against a surface of the sheet where the opposing sheet surface is backed by a surface substantially impermeable to the fluid.

13. The system of claim 12, wherein the impermeable surface is a calender roll.

14. The system of claim 9, wherein the sheet is paper and the fluid is steam.

15. The system of claim 9, wherein the calender stack is a supercalender.

16. The system of claim 9, further comprising a sheet travelling between the nips of the calender stack.

17. A method for controlling a physical characteristic of a sheet being calendered, comprising the step of:

controllably discharging a fluid against the surface of the sheet at a location substantially immediately before the sheet enters one nip of a calender stack, the one nip being located downstream from the nips of the calender stack affecting the desired caliper of the sheet, such that a physical characteristic of the sheet may be changed without affecting the desired caliper of the sheet.

18. The method of claim 17, wherein the fluid is discharged against the sheet surface where the sheet surface is backed by a surface substantially impermeable to the fluid.

19. The method of claim 18, wherein the impermeable surface is a calender roll.

20. The method of claim 17, further comprising the steps of:

measuring the physical characteristic of the sheet; and controlling the amount of fluid discharged against the sheet surface based upon the measured physical characteristic and predetermined physical characteristic values.

21. The method of claim 17, wherein the fluid is steam, the sheet is paper and the physical characteristic is smoothness.

22. The method of claim 17, wherein the calender stack is a supercalender.

23. The method of claim 17, wherein the one nip pressing the sheet is the last furthest downstream nip of the calender stack.

24. The method of claim 17, wherein the one nip pressing the sheet is the next to the last furthest downstream nip of the calender stack.

* * * * *